US006217017B1

(12) United States Patent
Yamazaki

(10) Patent No.: US 6,217,017 B1
(45) Date of Patent: Apr. 17, 2001

(54) PAPER-FEEDING APPARATUS AND METHOD OF FEEDING PAPER

(75) Inventor: Keiichiro Yamazaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/299,584

(22) Filed: Apr. 27, 1999

(30) Foreign Application Priority Data

Apr. 28, 1998 (JP) ..... 10-119410

(51) Int. Cl.[7] ..... B65H 3/52
(52) U.S. Cl. ..... 271/121
(58) Field of Search ..... 271/121

(56) References Cited

U.S. PATENT DOCUMENTS

| | | | | |
|---|---|---|---|---|
| 5,113,994 | * | 5/1992 | Mueck | 198/395 X |
| 5,226,743 | * | 7/1993 | Jackson et al. | 400/625 X |
| 5,316,285 | * | 5/1994 | Olson et al. | 271/122 X |
| 5,326,091 | * | 7/1994 | Giacometto et al. | 271/10 |
| 5,485,991 | * | 1/1996 | Hirano et al. | 271/121 |
| 5,655,762 | * | 8/1997 | Yergenson | 271/121 |
| 5,882,004 | * | 3/1999 | Padget | 271/119 X |

* cited by examiner

*Primary Examiner*—Christopher P. Ellis
*Assistant Examiner*—Kenneth W. Bower
(74) *Attorney, Agent, or Firm*—Rabin & Champagne, PC

(57) ABSTRACT

A paper-feeding apparatus is used for feeding print medium from a paper cassette. The paper cassette holds a stack of print paper therein. The feeding roller is disposed close to a forward end of the paper cassette. The feeding roller engages a top page of the stack of print paper to feed the top page from the paper cassette to a printing area. The paper separator engages the feeding roller to cooperate with the feeding roller to separate the top page from the stack of print paper. The paper-positioning member is, for example, an arm. When the feeding roller is not feeding the print medium, the arm pushes back the forward ends of pages of print medium toward the rear end of the paper cassette, thereby aligning the forward ends of the pages of the stack of print paper. The paper feeding apparatus may further have an urging member, e.g., a spring, which urges the paper separator against the feeding roller, and an urging-force-changing member, e.g., a cam that changes an urging force of the urging member. When the cam rotates to a high-pressure position, the cam pushes the spring to cause the spring to urge the medium separator against the feeding roller with a larger force. When the cam rotates to a low-pressure position, the cam pushes the spring to cause the spring to urge the medium separator against the feeding roller with a smaller force.

8 Claims, 10 Drawing Sheets

PAPER-FEEDING APPARATUS AND METHOD OF FEEDING PAPER

BACKGROUND OF THE INVENTION

1. Field of the Invention

The present invention relates to a paper-feeding apparatus and a method of feeding paper.

2. Description of the Related Art

Conventional paper-feeding apparatuses are of a construction where a platform or sheet guide frame is pushed upward by the urging force of a pressure spring so that the print medium placed on the platform is pressed against a feeding roller. A controller provides an instruction to a paper-feeding motor and the paper-feeding motor drives the feeding roller into rotation to advance the print medium from the platform.

When feeding the print medium from the platform, a plurality of pages of print medium may be advanced simultaneously by chance from the platform. In order to prevent such a simultaneous advancement of pages, a separator wall is provided which is formed of a film and located at the forward end of the platform. The separator wall obstructs the plurality of pages and allows only the top page to be fed. There is also provided a brake shoe formed of a foamed material that opposes the feeding roller, and the forward end of the print medium is allowed to abut the brake shoe. The top page of the print medium is advanced by a frictional force between the feeding roller and the print medium and the following pages are trapped by the rough surface of the brake shoe.

One conventional paper-feeding apparatus is provided with a cam mechanism provided at each longitudinal end of a shaft of the feeding roller. The platform is moved upward and downward as the feeding roller rotates. When not feeding the print medium, the platform is moved away from the feeding roller so that a user can easily place a stack of print medium into the platform. The platform does not exert any load on the print medium when the print medium is being advanced by a main feeding roller once the print medium has been fed by the feeding roller.

Another conventional paper feeding apparatus is provided with a feeding roller having a D-shaped cross-section. In other words, the feeding roller is generally a deformed cylinder that has been partially cut away in a plane parallel to a longitudinal axis of the cylinder. When not feeding the print medium, the flat surface of the feeding roller opposes the brake shoe, creating a gap between the flat surface and the brake shoe. Thus, the feeding roller is not in contact with the print medium and does not interfere with the print medium being advanced from the platform.

The feeding roller has idle rollers that have a smaller diameter smaller than the feeding roller and freely rotate on the shaft of the feeding roller. When the flat surface of the feeding roller opposes the brake shoe, the idle rollers are brought into contact with the brake shoe, thereby preventing the print medium placed on the platform from being advanced inadvertently.

However, the aforementioned conventional paper-feeding apparatuses cannot ensure that print medium of various kinds such as thin paper, thick paper, envelopes and so on is advanced one page at a time. In general, a plurality of pages tend to be advanced simultaneously when thin print medium is fed while paper feeding often fails when thick print medium is fed.

Pressing the brake shoe against the feeding roller with a larger force in an attempt to prevent multi-page feeding will cause failure of a paper feeding operation if the print medium is thick. Pressing the brake shoe against the feeding roller with a smaller force in an attempt to prevent failure of a paper feeding operation will cause multi-page feeding.

SUMMARY OF THE INVENTION

The present invention was made in view of the aforementioned drawbacks of the prior art paper-feeding apparatus.

An object of the invention is to provide a paper feeding apparatus for a printer and a method of feeding print medium paper feeding.

A paper-feeding apparatus includes a medium-container, a medium-feeding member, a medium separator, and a medium-positioning member.

The medium-container is, for example, a paper cassette that accommodates a stack of print medium therein. The medium-feeding member is, for example in the form of a feeding roller disposed close to a forward end of the paper cassette. The feeding roller engages a top page of the stack of print medium to feed the top page from the stack of print medium to a printing area. The medium-separator is disposed to oppose the feeding roller to engage the feeding roller, thereby cooperating with the feeding roller to separate the top page from the stack of print medium. The medium-positioning member is in the shape of, for example, an arm. When the feeding roller is not feeding the print medium, the arm pushes back the forward ends of pages of print medium toward the rear end of the paper cassette, thereby aligning the forward ends of the pages of the stack of print medium.

The paper feeding apparatus may further have an urging member in the form of, for example, a spring that urges the medium-separator against the medium-feeding member, and an urging-force-changing member that changes an urging force of the urging member. The urging-force-changing member is, for example, a cam mounted on a shaft rotated by operating a lever radially extending from the shaft. When the lever is moved to a high-pressure position, the cam engages a holder on which the spring is mounted and pushes, causing the spring to further urge the medium separator against the feeding roller.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE INVENTION

Preferred embodiments of the present invention will be described in detail with reference to the accompanying drawings.

FIRST EMBODIMENT

Construction

Figure 1:
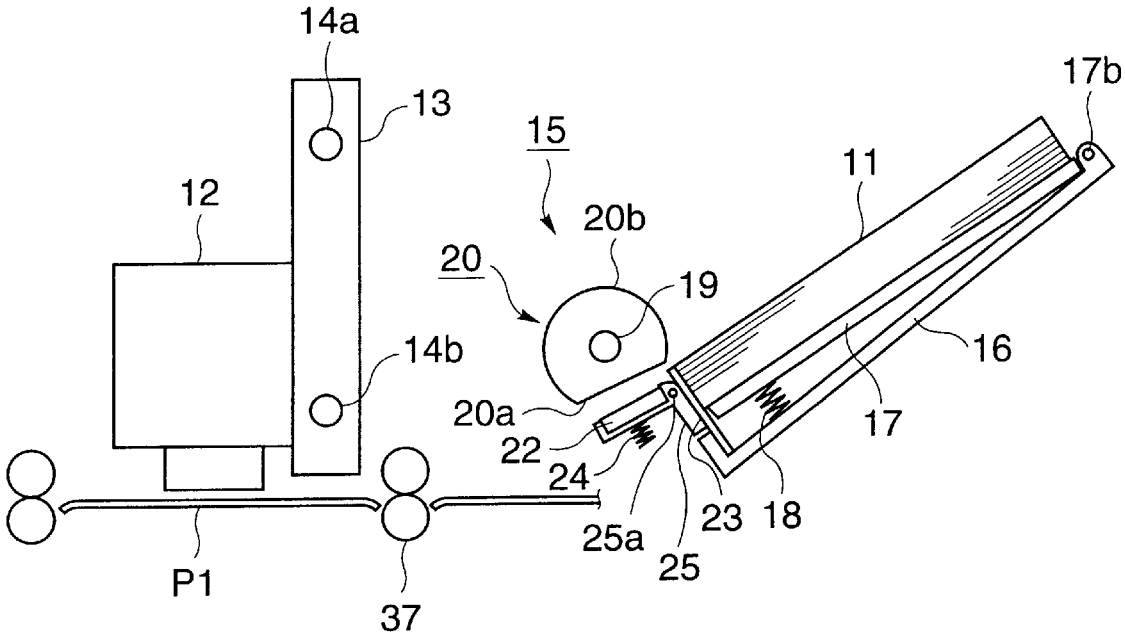
FIG. 1 is a general construction of a paper-feeding apparatus according to a first embodiment.

FIG. 1 illustrates a general construction of a paper-feeding apparatus according to a first embodiment.

Referring to FIG. 1, a carriage 13 runs on two parallel guide shafts 14*a* and 14*b*. The carriage 13 supports a print head 12 thereon. A paper feeding apparatus 15 includes a base frame 16, platform 17, pressure spring 18, feeding roller 20, and brake shoe 22. A stack of print medium 11 such as thin paper, thick paper, and envelopes is accommodated in the base frame 16 inclined at an angle with the horizontal. The base frame 16 supports the platform 17 thereon. The platform 17 supports the stack of print medium 11 thereon and is pivotal about a pin 17*b* relative to the base frame 16. The platform 17 is urged upward by the pressure spring 18 disposed on the bottom of the base frame 16, so that the top page of the print medium 11 is pressed against the feeding roller 20.

The feeding roller 20 rotates on a shaft 19 disposed near the forward end of the base frame 16. The feeding roller 20 is generally a deformed cylinder that has been partially cut away in a plane parallel to the longitudinal axis of the cylinder.

Figure 2A:
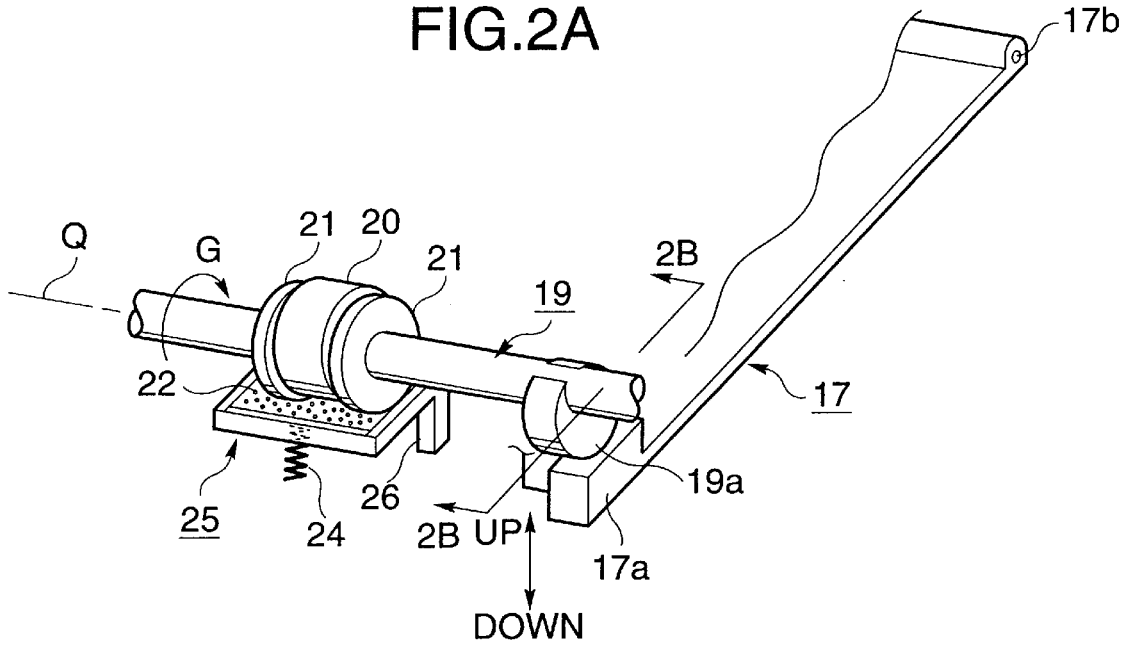
FIG. 2A is a perspective view of a paper feeding apparatus according to the first embodiment.

FIG. 2A is a perspective view of a paper feeding apparatus according to the first embodiment.

Figure 2B:
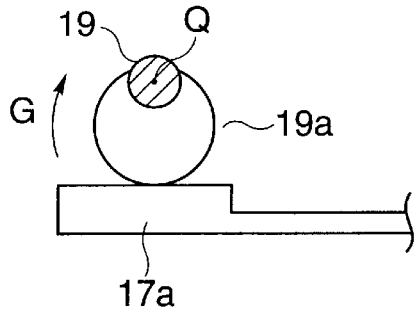
FIG. 2B is a partial cross-sectional view taken along lines 2B—2B of FIG. 2A.

FIG. 2B is a partial cross-sectional view taken along lines 2B—2B of FIG. 2A.

A motor 30 (FIG. 10) drives the feeding roller 20 in rotation in a direction shown by arrow G, thereby advancing the print medium 11. Idle rollers 21 are also mounted on the shaft 19 such that the feeding roller 20 is between the idle rollers 21. The idle rollers 21 have a smaller diameter than the feeding roller 20 and freely rotate.

A cam 19*a* is eccentrically formed in one-piece construction with the shaft 19 and engages a slide portion 17*a* of the platform 17. When the shaft 19 rotates, the cam 19*a* cams the platform 17 so that the platform 17 pivots about a pin 17*b* upward and downward.

The brake shoe 22 is made of rubber or a foamed rubber and is disposed to oppose the feeding roller 20 and idle rollers 21. The brake shoe 22 serves as a separator that cooperates with the feeding roller 20 to separate the top page from the following pages of the print medium 11. The foamed rubber is advantageous in that even if its surface wears out, the surfaces of new foams are exposed, thereby maintaining the same frictional force. The rubber brake shoe 22 may have a roughened surface for increased friction.

Figure 3:
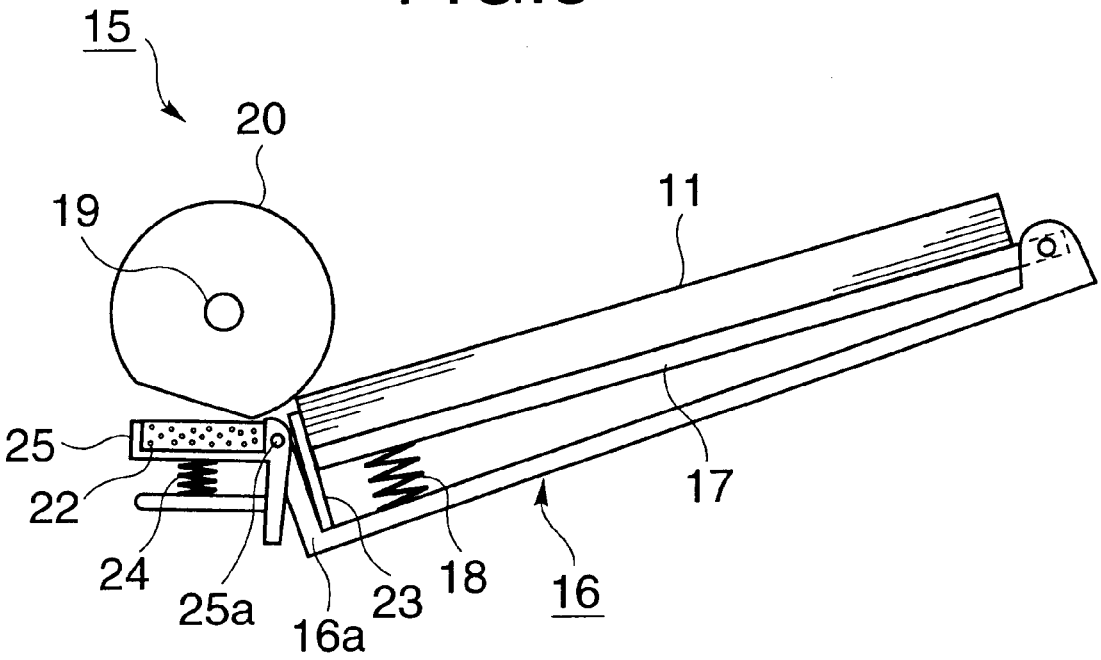
FIG. 3 is a side view of the paper-feeding apparatus.

FIG. 3 is a cross-sectional view of the paper-feeding apparatus 15.

Figure 4:
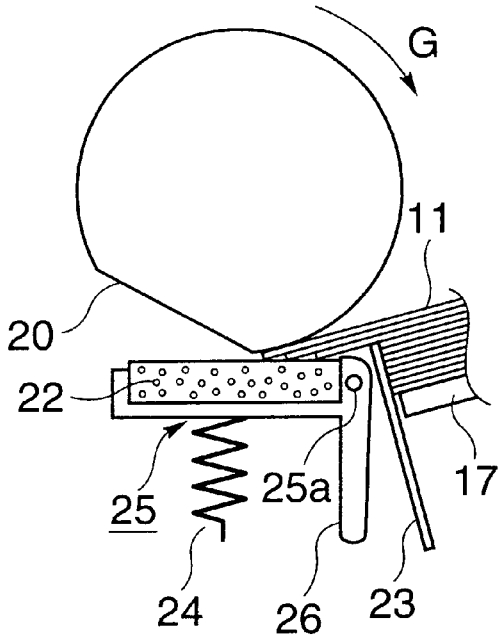
FIG. 4 is an expanded view of a relevant portion of the first embodiment.

FIG. 4 is an enlarged view of a relevant portion of FIG. 3.

The base frame 16 has a front wall 16*a* at its forward end. A separator wall 23 is provided beside the front wall 16*a* inside the base frame 16 and is formed of a film. The front wall 16*a* is disposed to oppose the feeding roller 20 and serves as a separator. A holder 25 is pivotally mounted to the upper end portion of the front wall 16*a* by means of a pin 25*a*. The holder 25 is positioned outside of the base frame 16 and under the feeding roller 20. Disposed under the holder 25 is a spring 24 that urges the holder 25 so that the brake shoe 22 is pressed against the round surface of the feeding roller 20 when the feeding roller 20 rotates.

When the feeding roller 20 rotates in the direction shown by arrow G, the print medium 11 accommodated in the platform 17 is advanced to main feed rollers 37, one top page at a time, with the aid of the separator wall 23 and the brake shoe 22. The print medium 11 is then transported by the main feed rollers 37 to a print area P1 of the printer where the printhead 12 opposes the print medium 11 and prints information on the print medium 11.

Figure 5:
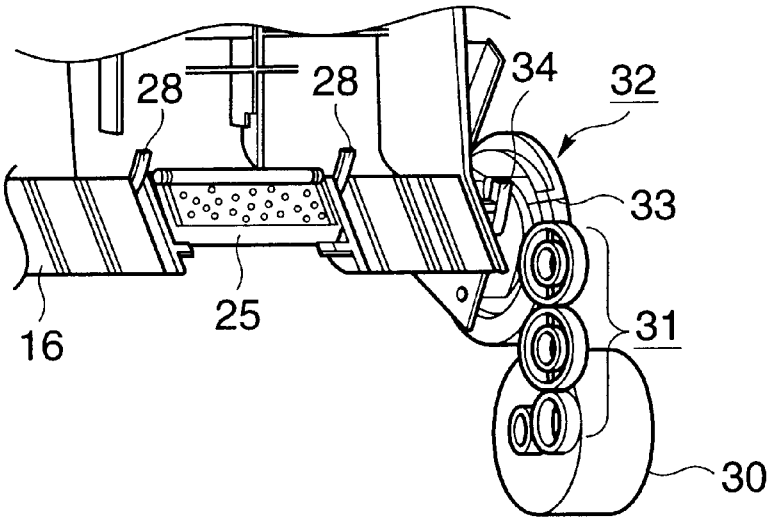
FIG. 5 is a perspective view of the paper positioner according to the first embodiment.

FIG. 5 is a perspective view of a paper positioner and surroundings according to the first embodiment.

Figure 6:
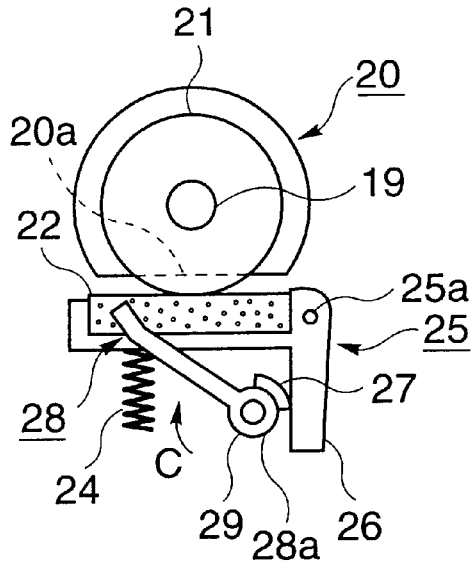
FIGS. 6 and 7 illustrate the operation of the paper-feeding apparatus according to the first embodiment.
Figure 7:
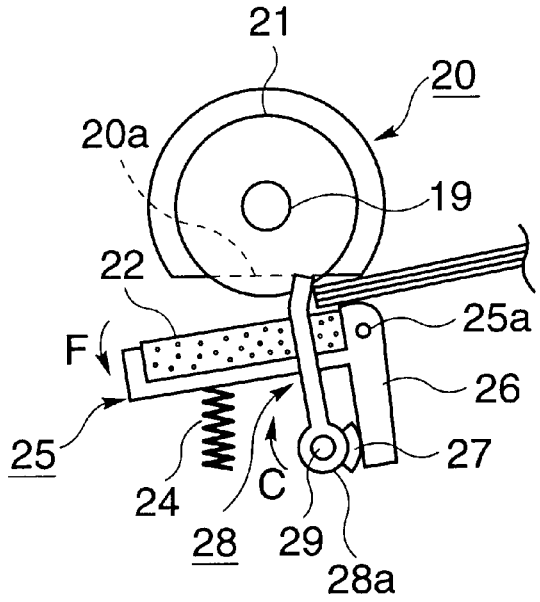

FIGS. 6 and 7 are side views of the paper feeding apparatus of the first embodiment.

Referring to the figures, arms 28 are pivotally disposed with the holder 25 positioned therebetween. The arm 28 is pivotal about a shaft 29 supported on the base frame 16. The arm 28 has a hub 28*a* on which a cam 27 is mounted. The cam 27 opposes an arm 26 of the holder 25. When the feeding roller 20 is not operating to feed the top page of the print medium 11 from the platform 17, the arm 28 pushes back the forward ends of the upper pages of print medium 11 toward a rearward end of the base frame 16 as shown in FIG. 7, thereby aligning the forward ends of the pages evenly. When the feeding roller 20 is operating to feed the print medium 11, the arm 28 pivots away from the forward ends of the print medium 11 as shown in FIG. 6.

Figure 8:
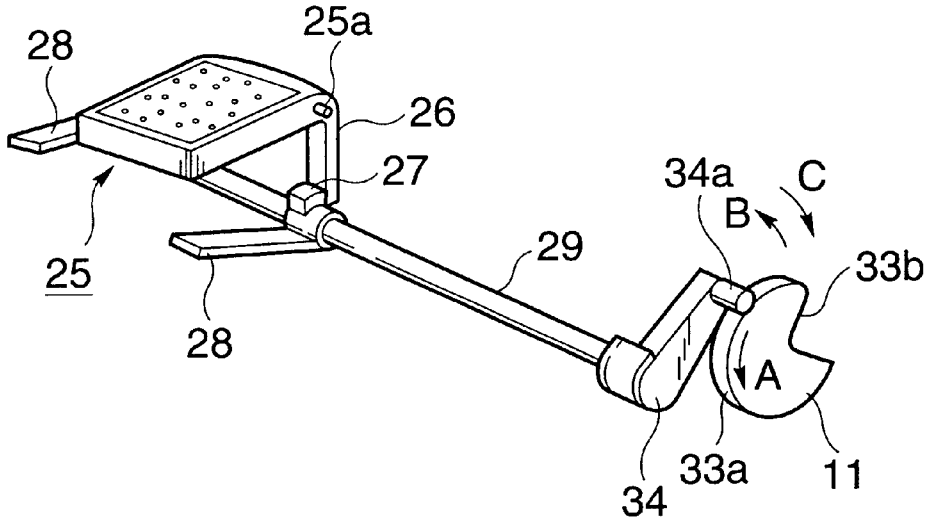
FIG. 8 illustrates an arm according to the first embodiment.

FIG. 8 illustrates the arm according to the first embodiment.

Figure 9:
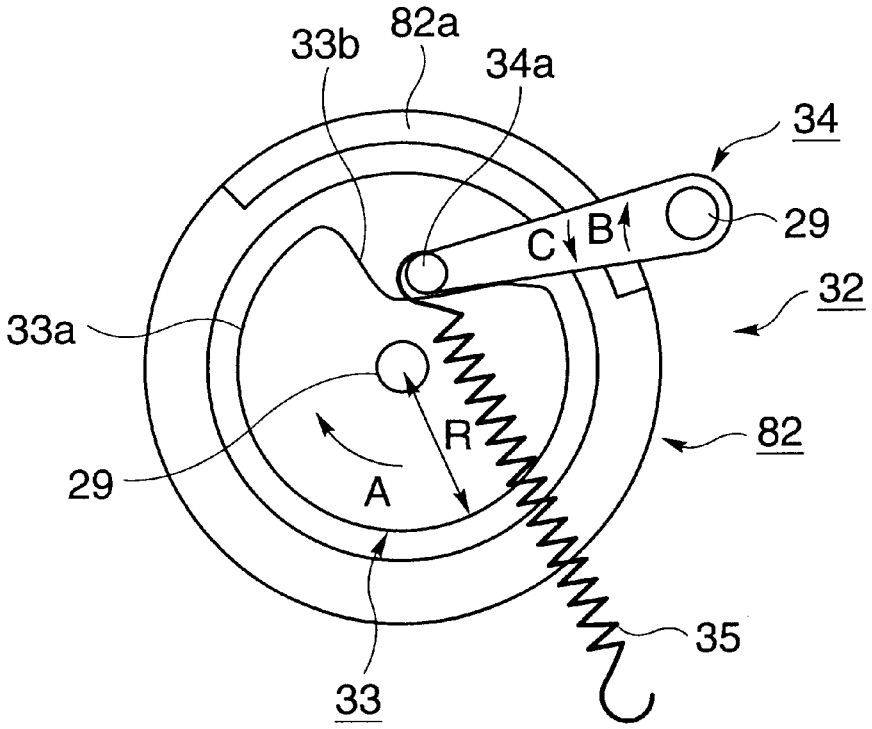
FIG. 9 illustrates a gear cam.

FIG. 9 illustrates a gear cam 32.

The shaft 29 has a radially extending lever 34 mounted at its one end. The lever 34 has a roller 34*a* attached to its free end portion. The roller 34*a* is urged by a tension spring 35 against the cam 33. The cam 33 has a constant-radius surface 33*a* that is the same distance or radius R from the shaft 29 and a varying-radius surface 33*b* that is at distances, shorter than R, from the shaft 29. The lever 34 pivots in directions shown by arrows B and C as the gear cam 32 is rotated in a direction shown by arrow A.

Figure 10:
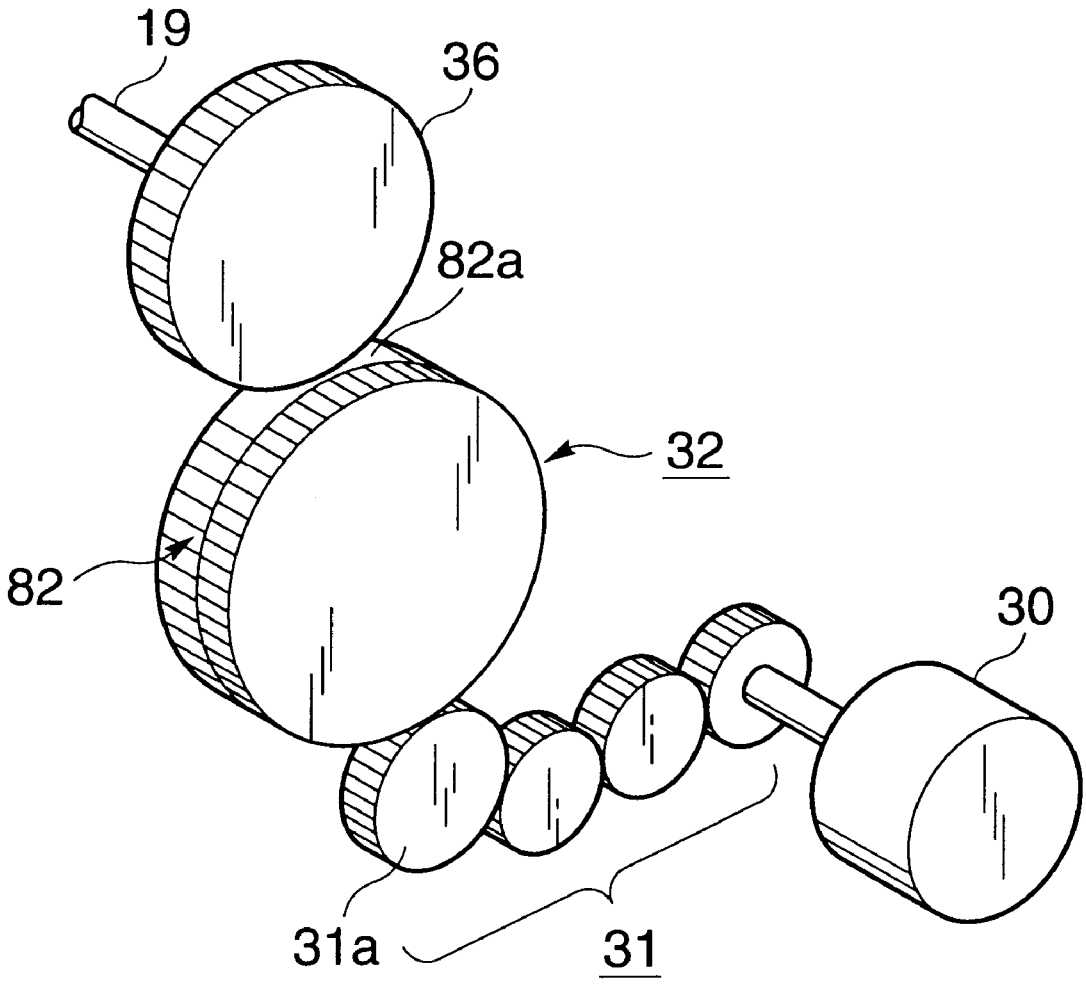
FIG. 10 illustrates a gear train.

FIG. 10 illustrates a gear train 32.

The feeding roller 20 is driven by the motor 30 in rotation. There is provided an idle gear train 31 between the motor 30 and the gear cam 32. The gear cam 32 includes a cam 33 and gear 82 that rotates together with the cam 33.

The gear 82 is cut away over a predetermined length of arc to form a cutout 82*a*. The cutout 82*a* is at the same angular position as the varying-radius surface 33*b* with respect to the shaft back 29 and is radially outward than the varying-radius surface 33*b* (FIG. 9).

As shown in FIG. 10, a final gear 31*a* of the idle gear train 31 is always in mesh with the gear cam 32 but the feed roller gear 36 does not mesh with the gear 82 at the cutout 82*a*.

Operation

The operation of the paper feeding apparatus 15 of the aforementioned construction will be described with reference to FIGS. 5–8 and FIG. 11.

Figure 11:
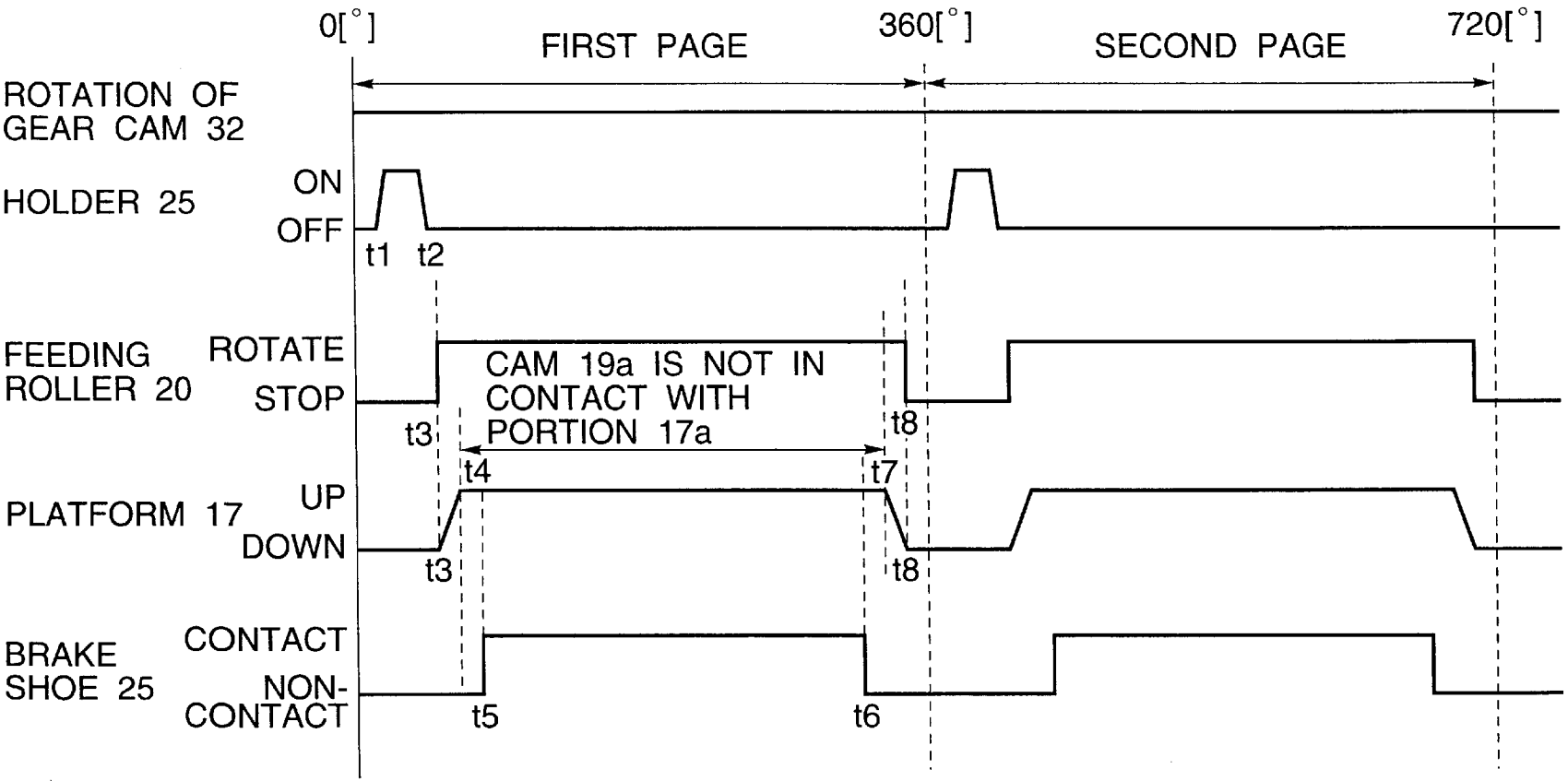
FIG. 11 is a timing chart illustrating the operation of the paper-feeding apparatus of the first embodiment.

FIG. 11 is a timing chart illustrating the operation of the paper-feeding apparatus.

Initially, the feeding roller 20 is at its standby position (FIG. 6) from where one complete rotation of the feeding roller 20 will start. With the feeding roller 20 is at the standby position, the arm 28 is at the position shown in FIG. 6 and the roller 34*a* is at the arc 33*a* while the feed roller gear 36 opposes the cutout 82*a* but does not mesh with the gear 82.

At the standby position, the user places a stack of print medium 11 in the paper guide frame 17. When a controller, not shown, provides a paper feed instruction to the motor 30, the motor 30 rotates. The rotation of the motor 30 is transmitted via the idle gear train 31 to the gear cam 32 and causes the gear cam 32 to rotate. As the gear cam 32 rotates, the roller 34*a* moves along the shape of the cam 33, moving into engagement with the varying-radius surface 33*b* at timing t1 so that the lever 34 and shaft 29 are rotated in the direction shown by arrow C.

Thus, as shown in FIG. 7, the arm 28 on the shaft 29 is rotated in the direction shown by arrow C, thereby aligning the forward ends of pages of the print medium 11 evenly. The cam 27 is also rotated in the direction shown by arrow C (FIG. 8), pushing the arm 26 so that the holder 25 is pivoted about the pin 25*a* away from the feeding roller 20 and idle roller 21 in the direction shown by arrow F.

At timing t2, the roller 34*a* is moved from the varying-radius surface 33*b* to the constant-radius surface 33*a* so that the lever 34 and shaft 29 are rotated in the direction shown by arrow B (Fig. 8). Accordingly, the arm 28 is rotated in the direction shown by arrow B (FIG. 8), leaving the forward ends of the pages of the print medium 11. The cam 27 is rotated away from the arm 26 with the result that the holder 25 is pivoted in such a direction as to approach the feeding roller 20 and idle roller 21, i.e., a direction opposite to the F direction (FIG. 7).

During the period from the beginning (t1) of the rotation of the gear cam 32 to timing t2, the feed roller gear 36 does not mesh with the gear 82. Therefore, the rotation of the motor 30 is not transmitted to the feed roller gear 36 so that the feed roller 20 is not rotated.

As the gear cam 32 further rotates, the feed roller gear 36 is brought into meshing engagement with the gear 82 so that the shaft 19 and feeding roller 20 are driven into rotation. As the shaft 19 rotates, the platform 17, which has been depressed at a portion 17*a* by the cam 19*a* (FIG. 2), is moved upward by the pressure spring 18 at timing t4 so that the top page of the print medium 11 abuts the feeding roller 20.

Subsequently, the round surface 20*b* of the feeding roller 20 abuts the brake shoe 22 at timing t5. Since the idle rollers 21 have a smaller diameter than the feeding roller 20, the idle rollers 21 disengage from the brake shoe 22 when the round surface 20*b* abuts the brake shoe 22. The mechanism may be modified so that the idle rollers 21 are brought into contact with the brake shoe 22 due only to its own weight.

When the platform 17 is moved upward at t4, the upper pages of the print medium 11 abutting the feeding roller 20 is advanced by the rotation of the feeding roller 20 to the brake shoe side. The separator wall 23 separates upper several pages including the top page from the stack of the print medium 11. The separated first several pages abut the brake shoe 22 which in turn separates the first page from the several pages so that only the top page is fed to the print area P1 (FIG. 1). This mechanism prevents multi-page feeding.

At timing t6, the forward end of the top page arrives at the main feed roller 37, and the main feed roller 37 begins to transport the print medium 11. A flat surface 20*a* of the feeding roller 20 now opposes the brake shoe 22 and the idle rollers 21 are now in contact with the brake shoe 22. Since the flat surface 20*a* opposes the brake shoe 22 when not feeding the print medium 11, only the idle rollers 21 exert a small load on the print medium 11 while the print medium 11 is passing between the feeding roller 20 and the brake shoe 22.

As the shaft 19 further rotates, the cam 19*a* abuts the platform 17 at timing t7, causing the platform 17 to move downward against the urging force of the pressure spring 18. Thus, the platform 17 is set free from its paper-supplying task. As a result, only idle rollers 21 exert a small load on the print medium 11 while the print medium 11 is being advanced by the main feed roller 37. No load is exerted on the print medium 11 by the platform 17.

At timing t8, the platform 17 completes its downward movement and the feed roller gear 36 opposes the cutout 82*a* again. The feeding roller 20 is moved out of meshing engagement with the gear 82 and comes to a stop.

Even if some pages including the second page are advanced together over a short distance beyond the separator wall 23 during the last paper-feeding operation, the brake shoe 22 is moved out of engagement with the feeding roller 20 and idle rollers 21, and the arm 28 aligns the forward ends of the pages of print medium 11 evenly. This operation prevents multi-page feeding during the feeding of the second page.

Thus, less urging force is needed in pressing the brake shoe 22 against the idle rollers 21 and decreases chance of malfunction of the paper feeding operation.

The motor 30 is only necessary to be driven in one direction, when bringing the brake shoe 22 into and out of contact engagement with the feeding roller 20 and idle rollers 21, moving the platform 17 upward and downward, advancing the print medium 11 from the paper guide frame 17, and separating the top page from the stack of print medium 11. Thus, the construction and control of the paper feeding apparatus of the printer can be simplified.

SECOND EMBODIMENT

Construction

Elements of the same construction as those of the first embodiment have been given the same reference numerals and description thereof is omitted.

Figure 12:
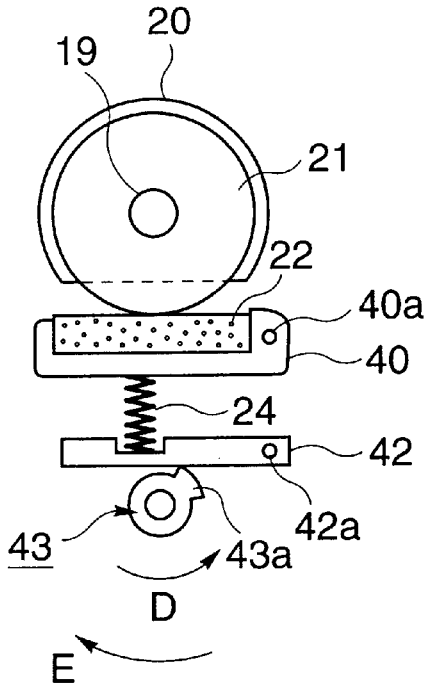
FIGS. 12 and 13 illustrate a brake shoe spring according to a second embodiment.

FIG. 12 is a side view of the paper feeding apparatus when it is at a "low pressure position."

Figure 13:
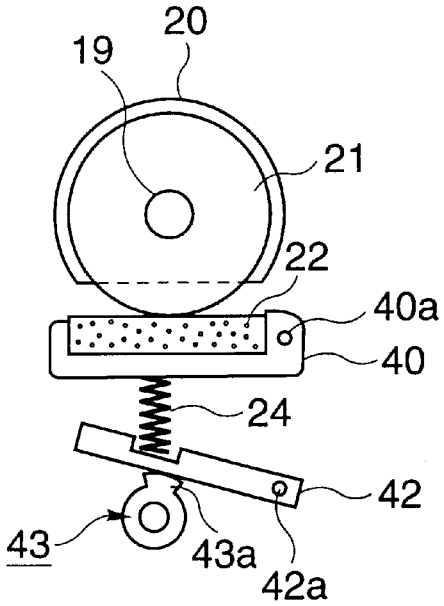

FIG. 13 is a side view of the paper feeding apparatus when it is at a "high pressure position."

Referring to FIGS. 12 and 13, the compression 24 urges the brake shoe 22 against the feeding roller 20. The spring 24 is substantially vertically mounted between the holders 40 and 42. The holder 40 is pivotally mounted to the base frame 16 by means of a pin 40*a* in the similar manner that the holder 25 is mounted to the base frame 16 as shown in FIG. 1. The holder 42 is also pivotally mounted to the base frame 16 by means of a pin 42*a*.

A cam shaft 43 is rotatably supported by the base frame 16 and has a cam 43*a* fixedly mounted to the cam shaft 43. The cam 43*a* is located under the holder 42. When the cam shaft 43 is rotated in a direction shown by arrow D, the cam 43*a* is brought into engagement with a bottom surface of the holder 42 as shown in FIG. 13.

Figure 14:
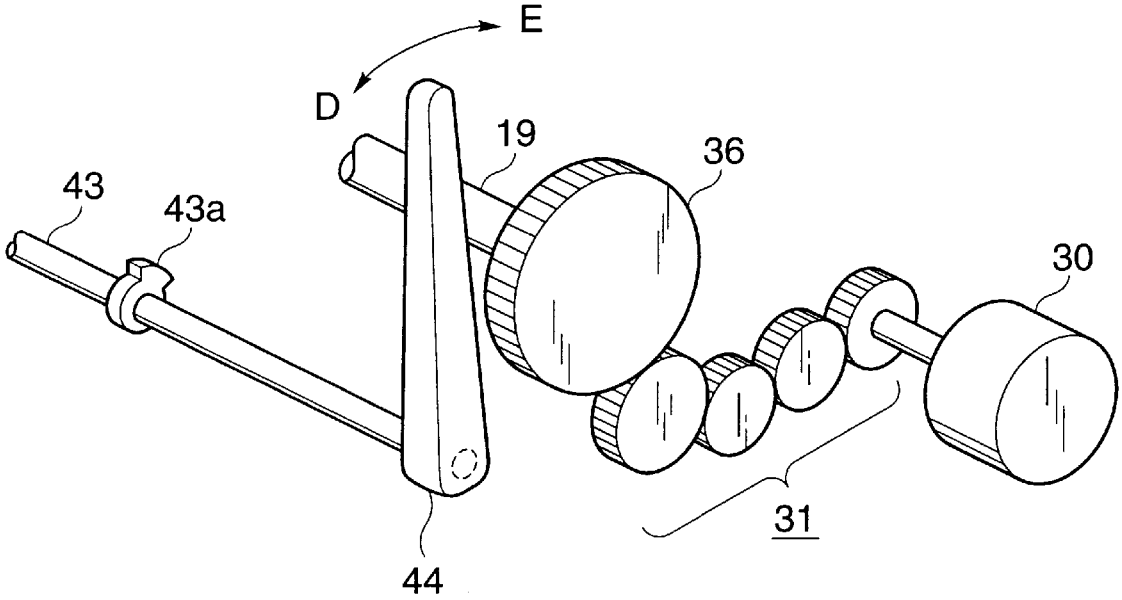
FIG. 14 illustrates a gear train according to the second embodiment.

FIG. 14 illustrates a gear train according to the second embodiment.

As shown in FIG. 14, the cam shaft 43 has a radially extending handle lever 44 secured at one end thereof.

When the user operates the handle lever 44 either in a direction shown by arrow D or in a direction shown by arrow E, the cam shaft 43 rotates to cause the cam 43*a* to engage or disengage from the bottom surface of the holder 42, so that the holder 42 pivots about the pin 42*a* relative to the base frame 16 between the "low pressure position" (FIG. 12) and the "high pressure position (FIG. 13)."

Operation

The operation of the aforementioned structure will now be described.

The user places a stack of print medium 11 on the platform 17 and operates the handle lever 44 for adjustment of the urging force of the spring 24.

If the print medium 11 is relatively thin, the handle lever 44 is shifted in the direction shown by arrow D to the high pressure position where the brake shoe 22 is pressed against the feeding roller 20 to develop more force that separates the top page from the rest. The larger force prevents multi-page feeding and does not cause malfunction of paper feeding operation of a thick print medium.

If the print medium 11 is relatively thick, the handle lever 44 is shifted in the direction shown by arrow E to the low pressure position as shown in FIG. 12 where the brake shoe 22 is not pressed strongly against the feeding roller 20 to develop less force that separates the top page of print medium 11 from the rest. The smaller force between the brake shoe 22 and the feeding roller 20 prevents malfunction of the paper feeding operation and does not cause multi-page feeding of a thin print medium.

When the motor 30 is driven in accordance with an instruction from the controller, not shown, the idle gear train 31 transmits the rotation of the motor 30 to the gear 36 so that the feeding roller 20 is driven into rotation. The operation of the second embodiment at timing t3 onward is the same as that of the first embodiment.

In the second embodiment, the user operates the handle lever 44 between the high-pressure position and the low-pressure position to change the pressure that the brake shoe 22 applies to the feeding roller 20. Alternatively, the shaft cam 43 may be rotated by a drive means such as a motor, not shown.

While the handle lever 44 is switched between two positions, i.e., the high pressure position and the low pressure position, the handle lever 44 may also be switched among three or more positions for smaller increments of pressure according to the kinds of print medium.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A paper-feeding apparatus, comprising:

a medium-container that holds a stack of print medium therein;

a medium-feeding member disposed close to a forward end of said medium-container, said medium-feeding member feeding a top page of the stack of print medium from said medium-container, said medium-feeding member including a feeding roller, and an idle roller that is contactable with the top page and is freely rotatable;

a medium-separator disposed to oppose said medium-feeding member, said medium-separator cooperating with said medium-feeding member to separate the top page from the stack of print medium, said medium-separator being urged against the idle roller to ensure that said feeding roller cooperates with the idle roller to feed only the top page;

a medium-positioning member that performs an alignment operation in which said medium-positioning member aligns forward ends of pages of the stack of print medium evenly when said medium-feeding member is not feeding the top page; and means that causes said medium-separator to disengage from the idle roller during the alignment operation.

2. The paper feeding apparatus according to claim 1, wherein said medium-positioning member engages the forward ends of the pages of the stack of print medium to push back the pages of print medium toward a rearward end of said medium-container when said medium-feeding member is not engaging the top page.

3. The paper-feeding apparatus according to claim 1, wherein said means is a cam mounted to said medium-positioning member, wherein when said medium-positioning member is aligning the pages of print medium, the cam engages said medium-separator so that said medium-separator disengages from the idle roller.

4. A paper feeding apparatus, comprising:

a medium-container that holds a stack of print medium therein;

a medium-feeding member disposed close to a forward end of said medium-container, said medium-feeding member feeding a top page of the stack of print medium from said medium-container;

a medium-separator disposed to oppose said medium-feeding member, said medium-separator cooperating with said medium-feeding member to separate the top page from the stack of print medium;

a medium-positioning member that aligns forward ends of pages of the stack of print medium evenly when said medium-feeding member is not feeding the top page;

a transport member that transports the top page fed by said medium-feeding member to a print area; and a separator disabling member that prevents said medium-separator from cooperating with said medium-feeding member when said transport member is transporting the top page to the print area.

5. The paper feeding apparatus according to claim 4, wherein said separator-disabling member is a cam that engages said medium separator to cause said medium-seperator to disengage from said medium-feeding member.

6. The paper feeding apparatus according to claim 4, wherein said medium-container includes an urging member that urges the stack of print medium so that the top page abuts said medium-feeding member; and wherein said medium-feeding member comprises an urging member-disabling member that prevents the urging member from urging the stack of print medium against said medium-feeding member when said transport member is transporting the top page to the print area.

7. The paper feeding apparatus according to claim 6, wherein said medium-feeding member is a roller and the urging member-disabling member is a cam eccentrically mounted to a rotating shaft of said medium-feeding member, wherein said medium-container comprises a platform on which the stack of print medium is placed, the platform being urged by an urging member;

wherein the cam rotates on the shaft and engages the platform to push the platform in such a direction as to move the stack of print medium away from said medium-feeding member when said medium-feeding member is not feeding the top page.

8. A method of feeding print medium for use in a printer, comprising:

causing a medium-feeding member to engage a top page of a stack of print medium accommodated in a medium container;

causing a medium-separator to cooperate with the medium-feeding member to separate the top page from the stack of printed medium while also urging said medium-separator against an idle roller to ensure that said medium-feeding member allows only the top page to be fed from said medium-container; and aligning, when said medium-feeding member is not engaging the top page, forward ends of pages of the stack of printed medium evenly while also causing said medium-separator to disengage from the idle roller.

* * * * *